US006891446B2

(12) United States Patent
Tayrani et al.

(10) Patent No.: US 6,891,446 B2
(45) Date of Patent: May 10, 2005

(54) COMPACT BROADBAND BALUN

(75) Inventors: Reza Tayrani, Marina Del Rey, CA (US); Kenneth A. Essenwanger, Walnut, CA (US)

(73) Assignee: Raytheon Company, Waltham, MA (US)

( * ) Notice: Subject to any disclaimer, the term of this patent is extended or adjusted under 35 U.S.C. 154(b) by 43 days.

(21) Appl. No.: 10/425,263

(22) Filed: Apr. 29, 2003

(65) Prior Publication Data

US 2004/0217823 A1 Nov. 4, 2004

(51) Int. Cl.[7] ..... H01P 5/08
(52) U.S. Cl. ..... 333/20; 333/1.1
(58) Field of Search ..... 333/1, 1.1, 19, 333/20; 307/106, 107

(56) References Cited

U.S. PATENT DOCUMENTS 4,697,158 A * 9/1987 Hoover et al. ..... 333/1.1
4,801,902 A * 1/1989 Hoover et al. ..... 333/1.1
4,882,553 A * 11/1989 Davies et al. ..... 333/26
5,903,827 A * 5/1999 Kennan et al. ..... 455/326

* cited by examiner

*Primary Examiner*—Timothy P. Callahan
*Assistant Examiner*—An T. Luu
(74) *Attorney, Agent, or Firm*—Leonard A. Alkov; Karl A. Vick

(57) ABSTRACT

A compact broadband balun (20). The balun (20) includes a waveguide transition (38) between one or more input ports (34, 54, 56) and one or more output ports (34, 54, 56) of the balun (20). A mechanism (36, 44), which depends on the tapered transition (38), provides a good match, while a resistor (44) provides isolation between input ports (34, 54, 56) and the output ports (34, 54, 56). In a specific embodiment, the balun (20) includes a first waveguide (34). One end of the first waveguide represents a first port of the balun (20). The balun (20) further includes a second wave guide (40, 42). Opposite ends (54, 56) of the second waveguide (40, 42) represent second (54) and third (56) ports. The waveguide transition (38) occurs between the first waveguide (34) and the second waveguide (40, 42). The waveguide transition (38, 44) is designed to provide a frequency-independent anti-phase response in response to an input signal provided at an input port (34). In alternative embodiment, microstrip waveguides are employed, and port inversion is achieved via a slotline inverter strategically positioned in the groundplane of the balun.

22 Claims, 3 Drawing Sheets

COMPACT BROADBAND BALUN

BACKGROUND OF THE INVENTION

1. Field of Invention

This invention relates to waveguides. Specifically, the present invention relates to miniature broadband slotline and microstrip baluns adapted for use with integrated circuits.

2. Description of the Related Art

Baluns are employed in various demanding applications including Delta Sigma (ΔΣ) modulators, Direct Digital Synthesizers (DDSs), microwave high-power amplifiers, half-bridge circuits, and high frequency power converters, which are commonly used in wireless communications transceivers and advanced radar exciter systems. Such applications often demand small broadband baluns that may be incorporated into integrated circuits.

Compact broadband baluns are particularly important in ΔΣ DDS applications, where good performance over a wide range of frequencies is desirable, and where accompanying transceiver design limitations necessitate miniature baluns. Previous attempts to produce broadband baluns suitable for use in ΔΣ DDS applications include the use of coupled transmission lines and spiral inductors. Unfortunately, these devices are undesirably large with relatively limited bandwidth. For example, baluns employing spiral inductors require larger inductance to operate at lower frequencies, which results in larger baluns which are difficult to incorporate into integrated circuits and have undesirable low-frequency cutoffs.

Hence, a need exists in the art for a miniature broadband balun suitable for chip-level integration. There exists a further need for an efficient ΔΣ DDS incorporating a compact integrated balun.

SUMMARY OF THE INVENTION

The need in the art is addressed by the compact broadband balun of the present invention. In the illustrative embodiment, the balun is adapted for use with Direct Digital Synthesizer (DDS) applications. The balun includes a waveguide transition between one or more input ports and one or more output ports of the balun. A mechanism, which depends on the transition, isolates the input ports and the output ports.

In a specific embodiment, the balun includes a first waveguide. One end of the first waveguide represents a first port of the balun. The balun further includes a second wave guide. Opposite ends of the second waveguide represent second and third ports. The waveguide transition occurs between the first waveguide and the second waveguide. The waveguide transition is designed to provide a frequency-independent anti-phase response in response to an input signal provided at one or more input ports.

In a more specific embodiment, the first and second waveguides are slotline waveguides, and the waveguide transition includes a slotline T-junction. The mechanism for isolating the input ports and the output ports includes a load-matching resistor and may include a taper in the first slotline waveguide. The load-matching resistor is positioned between a first leg and a second leg of the second slotline waveguide. The first leg corresponds to the second slotline waveguide on a first side of the transition. The second leg corresponds to the slotline waveguide on a second side of the transition. The slotline taper is an outward taper toward the transition and is positioned adjacent to the transition. The second port is positioned on a first side of the waveguide transition, and the third port is positioned on a second side of the waveguide transition.

In an alternative embodiment, the first and second waveguides are microstrip waveguides. A slotline inverter is positioned in a ground plane of the microstrip waveguides and facilitates frequency-independent anti-phase balun outputs. The isolation between the output ports may be provided by a resistor placed between the microstrip lines and the extended arms similar to the art of designing a Wilkinson device/combiner.

A first microstrip-to-slotline transition interfaces the second waveguide and the slotline inverter. A second slotline-to-microstrip transition interfaces the slotline to a third microstrip waveguide. One end of the third microstrip waveguide represents the second port. The slotline inverter is positioned on a first side of the microstrip T-junction. An opposite end of the second waveguide represents the third port of the balun and is positioned on a second side of the microstrip T-junction.

The novel design of the present invention is facilitated by the mechanism for isolating the input ports and the output ports, which includes a load matching resistor and/or strategically tapered slotlines for slotline T-junctions, or a slotline inverter positioned in the ground plane and coupled to one leg of a microstrip T-junction. These features facilitate desirable port isolation, thereby removing conventional design limitations and resulting in a new class of miniature broadband baluns particularly suited for DDS applications.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
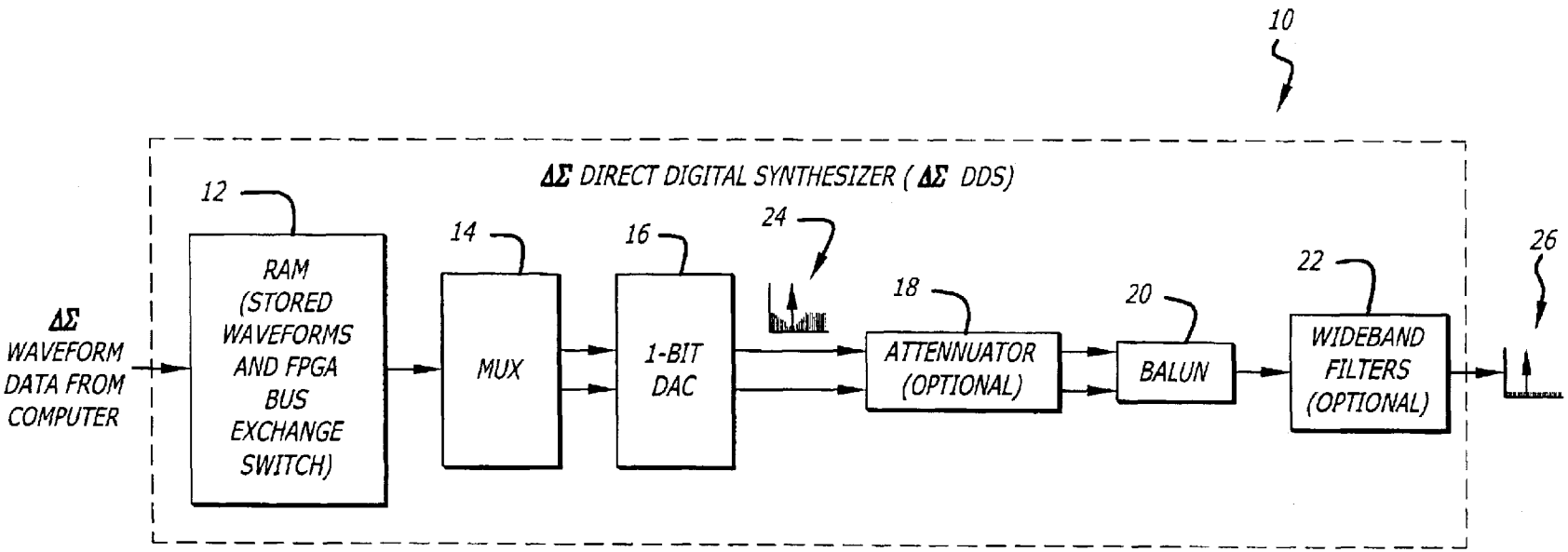
FIG. 1 is a diagram of a ΔΣ DDS employing a unique balun constructed in accordance with the teachings of the present invention.

FIG. 1 is a diagram of a ΔΣ DDS 10 employing a compact broadband balun 20 that is constructed in accordance with the teachings of the present invention. For clarity, various well-known components, such as power supplies, clocking circuitry, software feedback loops, and so on, have been omitted from the figures. However, those skilled in the art with access to the present teachings will know which components to implement and how to implement them to meet the needs of a given application.

The ΔΣ DDS 10 includes, from left to right, a Random Access Memory (RAM) 12, a Multiplexer (MUX) 14, a 1-bit Digital-to-Analog Converter (DAC) 16, an attenuator 18, and the broadband balun 20 and an optional set of wideband filters 22 that is connected at the output of the balun 20. The various components 12–22 are connected in series. The ΔΣ DDS 10 is a feed-forward system.

In operation, the ΔΣ DDS 10 outputs a desired waveform based on data stored in the RAM 12. ΔΣ DDS 10 may be used for various applications including waveform generation for fine frequency synthesis or for offset frequency generation.

Parameters specifying desired waveform characteristics, such as amplitude and frequency, are written to the RAM via a computer or other processor (not shown). The RAM incorporates a Field-Programmable Gate Array (FPGA) bus exchange switch for facilitating timing and control.

Digital waveform data is selectively input to the MUX 14 from the RAM 12 in response to control signaling from a computer or processor (not shown). The output of the RAM 12 is often a bus, such as a 32-bit bus. Each output bit is converted to a differential signal pair at the input of the MUX 14 via methods known in the art. The MUX 14 then provides a differential output signal on two conductors. The differential output signal represents a stream of single bits.

The 1-bit differential output signal from the MUX 14 is input to the 1-bit DAC 16. The 1-bit DAC 16 employs a 1-bit quantizer and a high sampling rate to compensate for the low resolution of the 1-bit quantizer. In many communications and radar applications, the output of the 1-bit DAC 16 will be a high-frequency, multi-GHz, pulsed signal that has excess quantization noise as represented by the spectrum 24. In addition, naturally occurring differences in rise and fall times of various transistors in the 1-bit DAC 16 and MUX 14 cause an undesirable common mode component in the differential outputs of the 1-bit DAC 16. The outputs of the 1-bit DAC 16 are often provided via microstrip transmission lines, dual slotlines, a coplanar waveguide, or coaxial cables.

Ideally, signals on the differential output lines are exactly 180° out of phase. When the signals are not exactly 180° out of phase, an undesirable common mode component exists. The balun 20 removes this undesirable common mode component and provides a single output based on the differential inputs.

The balun 20 employs a unique transition from unbalanced microstrip transmission line (3 conductors) to a balanced transmission line (two conductors) to reject the undesirable common mode component from the output of the 1-bit DAC 16. Any common mode energy that is not dissipated via the balun 20, and is reflected back, is absorbed via the optional attenuator 18. The attenuator 18 may be implemented as a pie attenuator. Alternatively, the input to the balun 20 may be back-terminated so that any energy reflected from the balun transition dissipates in the resistors of the back termination, thereby obviating the need for the attenuator 18.

The output of the balun 20 is then provided to a bank of wideband filters 22, which facilitate removal of noise, such as quantization noise, from the output of the balun 20. The output of the wideband filters 22 represents the desired spectrum 26, which is similar to the spectrum 24 but with undesirable signal components and noise removed via the balun 20 and the wideband filters 22. In some applications, the balun 20 and wideband filters 22 may be replaced by a suitable active filter. However, active filters may introduce prohibitive distortion for some applications.

Use of differential signals in the MUX 14 and 1-bit DAC 16 may reduce phase noise and pulse distortion, and may improve settling time and the Signal-to-Noise Ratio (SNR) of the ΔΣ DDS 10. Use of the balun 20 to reject common mode energy increases the SNR of the ΔΣ DDS 10.

Conventional baluns are often too large to be efficiently integrated in the ΔΣ DDS 10 chip. The balun 20 of the present invention is suitable for chip-level integration is readily implemented in GaAs and other integrated circuit chip environments.

This feed-forward ΔΣ DDS 10 eliminates stability issues associated with conventional ΔΣ DDS hardware and feedback loops. ΔΣ modulator feedback loops (not shown) employed by the ΔΣ DDS 10 reside in the software (not shown) running on the computer that generates the waveform parameters that are input to the RAM 12. The computer can simulate high-order ΔΣ modulators while maintaining loop stability.

Figure 2:
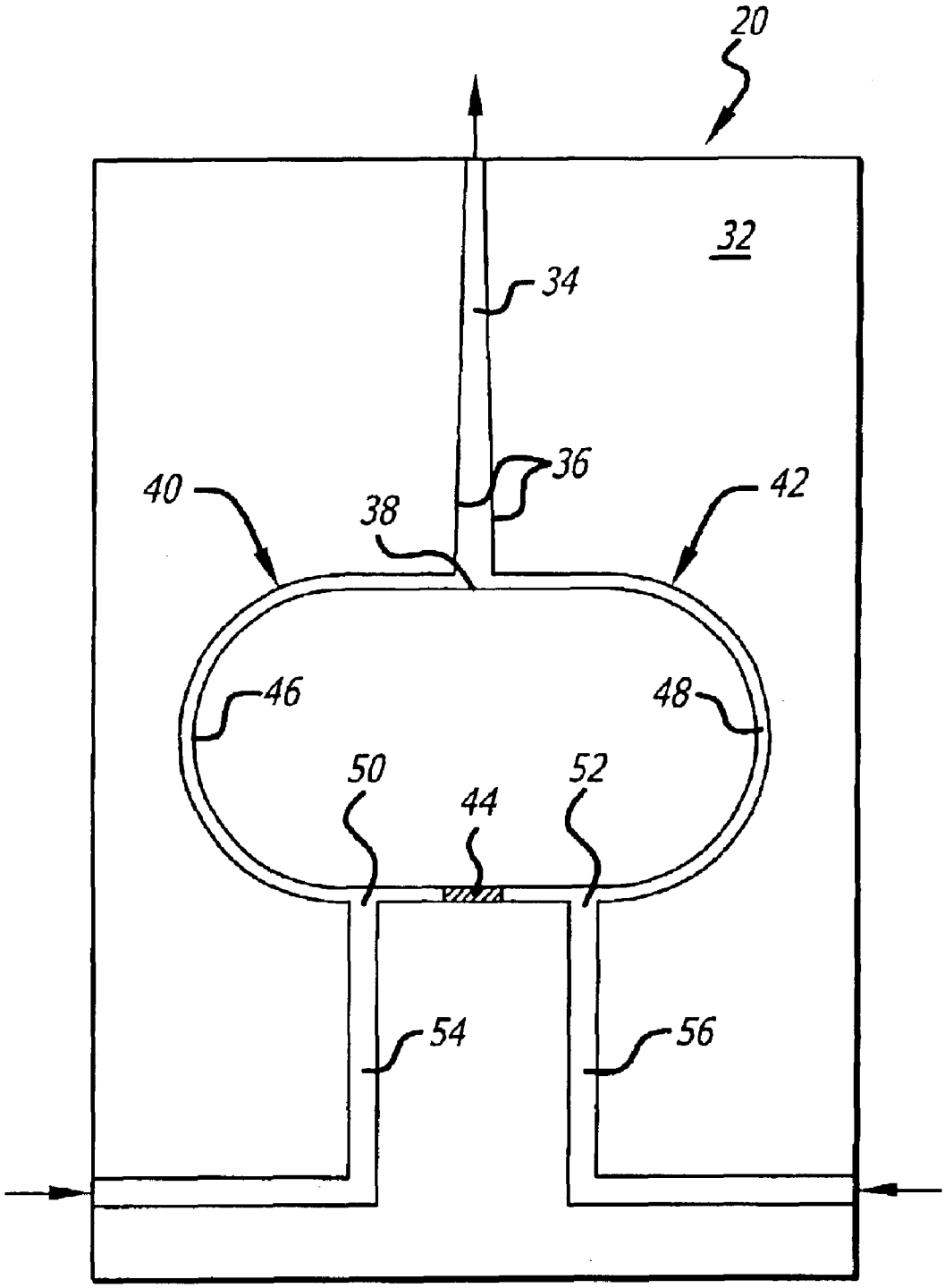
FIG. 2 is a more detailed diagram of the balun of FIG. 1.

FIG. 2 is a more detailed diagram of the balun 20 of FIG. 1. The balun 20 is implemented in a groundplane 32. A first slotline section 34 extends from a first port at a top edge of the ground plane 32 to a first slotline T-junction 38. The first slotline section 34 has strategically tapered sides 36 designed to facilitate port isolation and load matching. The tapered sides 36 form an outward taper toward the waveguide transition 38. At the first slotline T-junction 38, the balun 20 branches into a second slotline portion 40 and a third slotline portion 42. A load-matching resistor 40 is connected between the second slotline portion 40 and the third slotline portion 42. The waveguide sections 40 and 42 may be thought of as comprising a single slotline waveguide that intersects another slotline 34 at the junction 48.

The second slotline portion 40 and the third slotline portion 42, include first and second curved slotline portions 46 and 48, respectively. The first and second curved slotline portions 46 and 48 terminate at a second slotline T-junction 50 and a third slotline T-junction 52, respectively. A first rectilinear slotline leg 54 extends from the second slotline T-junction 50 and provides a second balun port. A second rectilinear slotline leg 56 extends from the third slotline T-junction 52 and provides a third balun port.

The load-matching resistor 44 is connected between remaining branches of the second slotline T-junction 50 and third slotline T-junction 52. The load-matching resistor 44 may extend from the second slotline T-junction 50 to the third slotline T-junction, without departing from the scope of the present invention.

In the present specific embodiment, the resistor 44 is a thin-film resistor. Alternatively, the resistor 44 is implemented via one or more transistors and may be a variable resistor. The resistance of the resistor 44 may then be selectively, automatically, and/or dynamically controlled via a controller (not shown) to adjust to changing signaling environments to maximize port isolation and matching.

The first curved slotline section 46 and the second curved slotline section 48 approximately form an oval which is connected at the load-matching resistor 44 and has the first tapered slotline section 34 and the rectilinear slotline sections 54 and 56 extending therefrom. The curved slotline sections 46 and 48 may be shaped differently without departing from the scope of the present invention. For example, instead of forming an oval, the curved slotline sections 46 and 48 may form an ellipse, circle, or other shape. Alternatively, the curved sections 46 and 48 may be replaced with rectilinear slotline sections. Use of the curved sections may provide a smooth impedance transformation between first slotline-T junction 38 and the second and third junctions 50 and 52, respectively.

In the preferred embodiment, the balun 20 is approximately physically symmetric about a line drawn through the center of the first tapered slotline section 34. The various dimensions of the slotlines 34, 40, and 42; the angle of the tapered edges 36; the value of the load-matching resistor 44; and the exact shapes of the curved slotline sections 46 and 48 are application-specific. Those skilled in the art with access to the present teachings will know which dimensions, values, and shapes to employ to meet the needs of a given application. One skilled in the art can employ widely available simulators and testing equipment to select applicable values.

In operation, differential signals, also called anti-phase signals, which are approximately 180° out of phase, are input to the first and second rectilinear slotline sections 54 and 56 of the second and third slotline portions 40 and 42, respectively. The differential signals combine at the first slotline-T junction 38, where any common mode component existing in the input signals is rejected. The rejected energy may reflect back, where it is dissipated in the load-matching resistor 44, which provides excellent port isolation between the three ports associated with the slotline waveguide sections 34, 54, and 56. Electromagnetic energy output from the balun 20 via the first tapered slotline section 34 is balanced and represents only the differential signal components input via the rectilinear slotline sections 54 and 56. The taper in the first slotline section 34 facilitates port isolation, as can be seen via use of a conventional waveguide simulation software package, such as Hewlett Packard's ADS Momentum EM simulator. Additional testing may be performed via a pulse generator and an oscilloscope.

Alternatively, the balun 20 may be operated in reverse, such that a signal is input via the first tapered slotline section 34, and two anti-phase output signals are output from the first and second rectilinear slotline sections 54 and 56. In this mode of operation, the taper 36 in the first tapered slotline section 34 and the load-matching resistor 44 facilitate port isolation. Port isolation is important in various applications for which the balun 20 may be used, such as push-pull amplifiers, high-efficiency microwave combining networks and power converters, and various types of half-bridge and full-bridge High Power Amplifiers (HPA's). Such applications often require a balun to have a frequency-independent, anti-phase response, such that dual differential signals are provided from a given input signal with good port isolation. When output ports are well-isolated, a load on one of the ports, such as the port associated with the first rectilinear slotline section 54, does not affect the signal on another port, such as the port associated with the second rectilinear slotline section 56.

Unfortunately, unlike the present invention, which is broadband, compact, and can operate from near DC to multi-GHz frequencies, existing baluns often lack sufficient port isolation, have undesirably limited bandwidth, and/or are excessively bulky and difficult to integrate with accompanying integrated circuits.

Hybrid slotline T-junctions are generally known in the art. However, such junctions are typically neither used as baluns nor used in $\Delta\Sigma$ DDS applications. Conventional hybrid slotline T-junctions lack the requisite isolated outputs, moreover, the three ports are not generally simultaneously load-matched.

The balun 20 may be easily incorporated into integrated circuits implemented on various substrates including GaAs and SiGr. Furthermore, the performance of the balun 20 does not depend on quarter wavelength sections. Consequently, the balun may be miniaturized as needed without compromising performance.

The balun 20 of represents a new class of miniature ultra broadband baluns that capitalize on unique properties of uniplanar slotline T-junctions, such as the slotline T-junction 38. The balun 20 has demostrtated an ultra broad bandwidth performace of Direct Current (DC) to 10.0 GHZ. Several such slotline baluns that were built and tested demonstrate the usefulness of this invention. Unlike conventional baluns, which are difficult to miniaturize and do not offer the requisite broadband performance, the broadband balun 20 is simple to fabricate and easy to integrate with SiGe, GaAs, or other integrated circuit technologies.

As is known in the art, a slotline is a planar balanced transmission line structure, wherein an input wave propagates along the slot with the major electric field components oriented across the slot. The mode of propagation is Transverse Electric field (TE) mode, similar to the conventional rectangular waveguide TE mode of propagation. However, unlike conventional rectangular waveguides, a slotline does not exhibit low-frequency cutoff, since the slotline is a two-conductor structure.

Conventional knowledge suggests that any loss-less multi-ports junction cannot be matched simultaneously at all ports. However, use of the novel tapered slotline section 34 enables good matching at the at the T-junction 38, which enables a simultaneous return loss of better than −10 dB at all ports over DC to 10 GHz. The new slotline T-junction balun 20, which lacks conventional size and performance limitations, can be matched simultaneously at all three ports over a broad bandwidth.

To facilitate incorporation of the balun 20 into various integrated circuit environments, waveguide transitions to slotlines may be employed. Microstrip-to-slotline transitions or coplanar waveguide-to-slotline transitions may be employed. However, to achieve good performance at frequencies below 1.0 GHz, a coaxial-to-slotline transition is preferable. In this transition (not shown), a miniature coaxial line is placed perpendicular to and at the end of an open-circuited slotline. The outer conductor of the coaxial cable is electrically connected, such as with gold ribbons, to the slotline metal in the left half of the slot plane. The inner conductor is extended over the slot and connected, such as via gold ribbon, to the slotline metal on the opposite side of the slot. For monolithic implementations, a coplanar slots-to-slotline transition is preferable.

Figure 3:
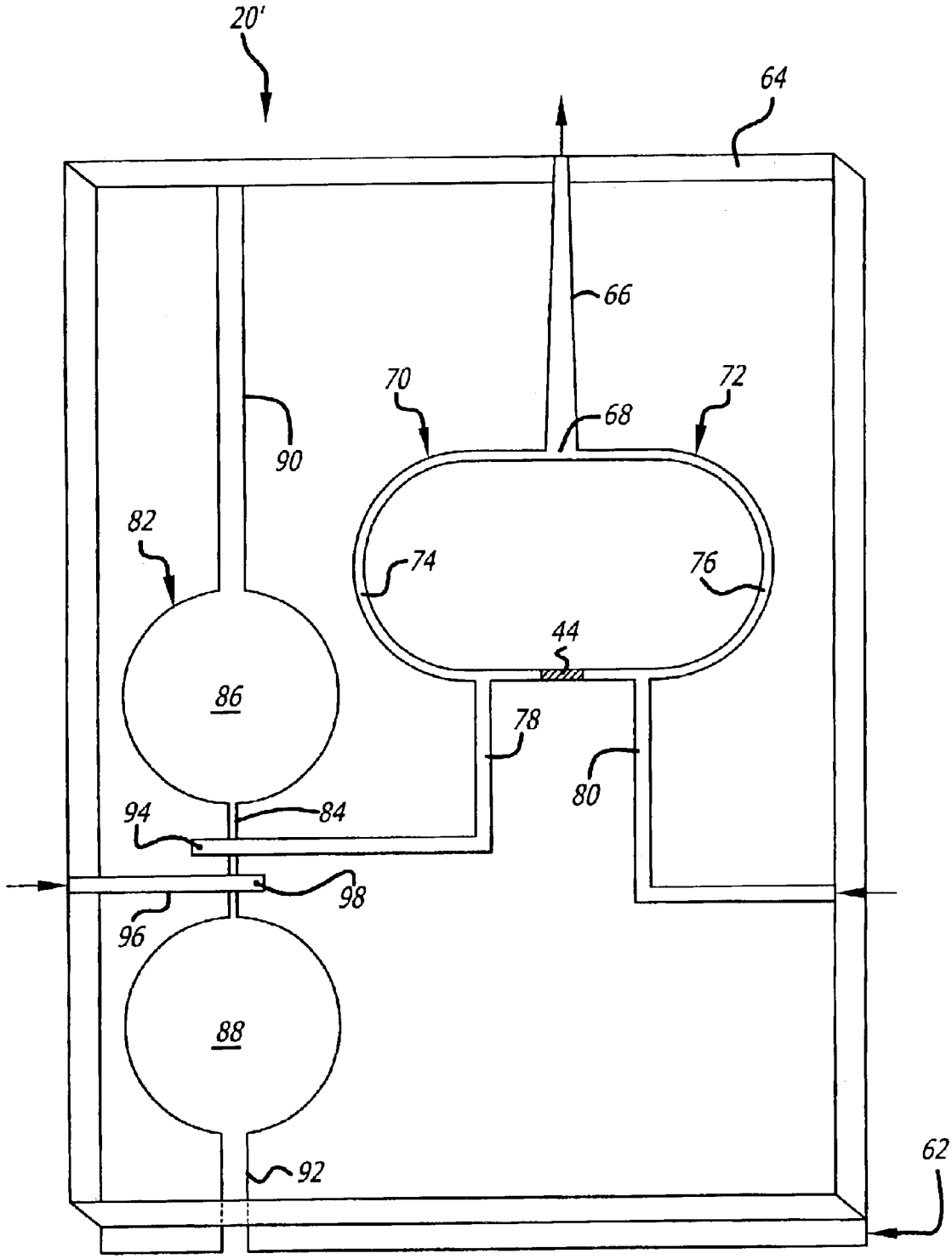
FIG. 3 is a more detailed diagram of an alternative embodiment of the balun of FIG. 1.

FIG. 3 is a more detailed diagram of an alternative embodiment 20' of the balun 20 of FIG. 1. The balun 20' employs a ground plane 62 with a dielectric 64 disposed thereon. A first tapered microstrip section 66 is disposed on or within the dielectric. Those skilled in the art will appreciate that the taper in the first tapered microstrip section 66 may be removed, without departing from the scope of the present invention.

The first tapered microstrip section 66 extends to the top edge of the dielectric 64 and ground plane 62, forming a top balun port at one end. The first tapered microstrip section 66 extends to a microstrip T-junction 68 at the opposite end. The balun 20' branches into a left portion 70 and a right portion 72 at the microstrip T-junction.

The left portion 70 includes a left curved microstrip section 74 extending from the microstrip T-junction 68. Similarly, the right portion 74 includes a right curved microstrip section 76 extending from the microstrip T-junction 68. The left curved microstrip section 74 transitions into a left rectilinear microstrip section 78, which is also part of the left portion 70. The right curved microstrip section 76 transitions into a right rectilinear microstrip section 80, which extends to a right edge of the dielectric 64 and ground plane 62 and provides a right balun port. The microstrips 74, 78 76, and 80 of the left waveguide portion 70 and the right waveguide portion 72 may be thought of as a single microstrip waveguide that intersects another microstrip waveguide 66 at the microstrip T-junction 68.

The curved microstrip sections 74 and 76 are shaped similarly to the curved slotline sections 46 and 48, respectively, of the balun 20 of FIG. 2. A load-matching resistor 44 is also included between the extension of the left portion 74 and the extension of the right portion 76, similar to a Wilkinson divider/combiner circuit. The curved microstrip sections 74 and 76 may be straightened, without departing from the scope of the present invention. This load-matching resistor 44, which also promotes port isolation, could be implemented in thin film or thick film resistive ink technology or as a variable resistor using active transistor devices.

The left rectilinear microstrip section 78 of the left portion 70 passes from right to left over a central slotline section 84 of a slotline inverter 82, which is implemented via slotline technology in the groundplane 62. The slotline inverter 82 includes a top circular section 86 and a bottom circular section 88, which are connected via the central slotline section 84. A top slotline section 90 extends from the top circular section 86 to the top edge of the groundplane 62. A bottom slotline section 92 extends from the bottom circular section 88 to a bottom edge of the groundplane 62.

The left rectilinear microstrip section 78 is connected to the ground plane 62 via a first groundplane connector 94 that passes through the dielectric 64 on the left side of the central slotline section 84. A second left rectilinear microstrip section 86 extends left from a second groundplane connector 98, over the central slotline portion 84, and to the left edge of the dielectric 64 and ground plane 62, thereby providing a left balun port.

The microstrip sections 66–80 act as a microstrip Wilkinson divider/combiner 66–80. The balun 20' combines the electrical properties of a microstrip Wilkinson divider/combiner 66–80 with that of the slotline inverter 82.

In operation, differential signals are input via the second left rectilinear microstrip section 96 and the right rectilinear microstrip section 80. The signal input to the left portion 70 experiences 180° of phase rotation introduced by the slotline inverter 82 in the ground plane 62. The resulting desired signal components, which were differential input signal components, are in phase and add constructively at the microstrip T-junction 68. The resulting signal output from the first tapered microstrip section 66 lacks undesirable common mode components existing in the input signals, due to common mode component cancellation at the microstrip T-junction 68.

The balun 20' may be operated in reverse, such that the microstrip sections 96, 80 form a microstrip Wilkinson divider. The slotline inverter 82 is attached to the one of the Wilkinson divider output ports. This novel balun 20' provides a broadband differential output and good isolation between output ports in response to a signal input via the first tapered microstrip section 66.

One skilled in the art may construct the baluns 20 and 20' via conventional integrated circuit technologies, using a thin or thick film fabrication process, without undue experimentation. The various dimensions of the waveguide components of the balun 20', the thickness of the dielectric 64, value of the dielectric constant, resistivity of the conductors employed, and so on, are application-specific. One skilled in the art may determine proper materials and dimensions to meet the needs of a given application. In the present specific embodiment, gold is the preferred metal, and alumina is the preferred dielectric. The exact dimensions are determined via computer simulation.

The baluns 20 and 20' were simulated via the HP ADS Momentum EM simulator. For the simulations, the substrates included 25 mils thick Alumina and Zirconium Titenate having dielectric constants of Er=9.9 and Er=40.0, respectively. Excellent anti-phase performances over a broad frequency range of DC-10 GHz were obtained. In addition, good amplitude tracking performance and a good simultaneous match at all three ports was obtained.

Hence, the present invention provides baluns 20 and 20' with theoretical frequency-independent anti-phase responses and broadband amplitude tracking capabilities. These miniature baluns 20 and 20' are suitable for direct integration in GaAs, SiGe, or other integrated circuit technologies. By incorporating the resistor 44 in the balun 20 the theoretical matching limitations are removed, and output ports may be simultaneously matched to provide good port isolation.

The measured data indicates that when such devices 20 and 20' are used as baluns, they may yield a phase accuracy of +/−5 degrees over DC-10 GHz. Furthermore, the baluns 20 and 20' possess amplitude tracking of better than 2 dB over the same frequency span. These test results may be further improved by using broadband transitions, such as coplanar strips-to-slotline transitions with each arm 40 and 42 of the slotline T-junction 38 of FIG. 2.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. A compact broadband balun comprising:

a waveguide transition between one or more input ports and one or more output ports;

means for isolating and/or matching said input ports and said output ports based on said transition, wherein said means for isolating and/or matching includes a load-matching resistor;

a first slotline waveguide, one end of said first waveguide representing a first port of said balun; and a second slotline waveguide, opposite ends of said second waveguide representing second and third ports;

wherein said waveguide transition occurs between said first waveguide and said second waveguide, said waveguide transition includes a load-matching resistor and/or a tapered waveguide section and a slotline T-junction, and said waveguide transition is shaped to provide a frequency-independent, anti-phase response in response to an input signal provided at said one or more input ports.

2. The balun of claim 1 wherein said means for isolating and/or matching includes a taper in said first slotline waveguide.

3. The balun of claim 2 wherein said load-matching resistor is positioned between a first leg and a second leg of said second slotline waveguide, said first leg corresponding to said second slotline waveguide on a first side of said transition, said second leg corresponding to said slotline waveguide on a second side of said transition.

4. The balun of claim 2 wherein said taper in said slotline is an outward taper toward said transition and is positioned adjacent to said transition.

5. A compact broadband balun comprising:

first means for receiving input electromagnetic;

second means for slitting said input electromagnetic energy into a first path and a second path; and third means for isolating said first path from said second path to produce a simultaneous load match at a first port and a second port associated with said first and second paths, respectively.

6. The balun of claim 5 wherein said first means includes an input slotline waveguide.

7. The balun of claim 6 wherein said second means includes a slotline T-junction that yields said first path and said second path, which are implemented via a first slotline waveguide and a second slotline waveguide, respectively.

8. The balun of claim 7 wherein said third means includes a taper in said input slotline waveguide to facilitate matching.

9. The balun of claim 8 wherein said third means further includes a resistor positioned between said first path and said second path and having a value chosen to facilitate load matching and port isolation.

10. The balun of claim 9 wherein said resistor is a variable resistor.

11. The balun of claim 9 wherein said resistor includes a transistor.

12. A compact broadband balun comprising:

an input slotline for receiving input electromagnetic energy;

a junction for directing said input electromagnetic energy along a first path and a second path; and means for isolating and matching ports associated with said first path and said second path, including a resistor between said first path and said second path.

13. The balun of claim 12 wherein said means for isolating and matching ports includes a taper in said input slotline at said junction.

14. The balun of claim 12 wherein said waveguide transition is shaped so that a signal input to said balun via said input slotline yields anti-phase output signals at said output ports, which are isolated.

15. The balun of claim 12 further including means for facilitating operating said balun in reverse so that differential electromagnetic energy input to said output ports results in an output signal from said input port, said output signal lacking common mode energy.

16. An efficient Delta-Sigma Direct Digital Synthesizer ($\Delta\Sigma$ DDS) comprising:

first means for selectively outputting parameters corresponding to a desired waveform;

second means for providing a digital signal conforming to said parameters;

third means for employing differential quantization via a 1-bit Digital-to-Analog Converter (DAC) to convert said digital signal to a differential mode analog signal; and an efficient balun for rejecting common mode energy from said differential mode analog signal via a slotline waveguide transition equipped with a load matching resistor and/or a tapered output slotline and providing an analog output signal in response thereto.

17. A compact broadband balun comprising:

a waveguide transition between one or more input ports and one or more output ports;

means for isolating and/or matching said input ports and said output ports based on said transition, wherein said means for isolating and/or matching includes a load-matching resistor;

a first microstrip waveguide, one end of said first waveguide representing a first port of said balun;

a second microstrip waveguide, opposite ends of said second waveguide representing second and third ports;

wherein said waveguide transition occurs between said first waveguide and said second waveguide and said waveguide transition is shaped to provide a frequency-independent, anti-phase response in response to an input signal provided at said one or more input ports; and wherein said second port is positioned on a first side of said waveguide transition, and said third port is positioned on a second side of said waveguide transition.

18. The balun of claim 17 wherein said balun further includes a slotline positioned in a ground plane of said microstrip waveguides, said slotline a slotline inverter that facilitates frequency-independent, anti-phase balun outputs.

19. A compact broadband balun comprising:

a waveguide transition between one or more input ports and one or more output ports;

means for isolating and/or matching said input ports and said output ports based on said transition;

a first microstrip waveguide, one end of said first waveguide representing a first port of said balun;

a second microstrip waveguide, opposite ends of said second waveguide representing second and third ports;

a first microstrip-to-slotline transition interfacing said second waveguide and said slotline and further including a slotline-to-microstrip transition interfacing said slotline to a third waveguide;

wherein said waveguide transition occurs between said first waveguide and second waveguide and said waveguide transition includes a microstrip T-junction and is shaped to provide a frequency-independent, anti-phase response in response to an impute signal provided at said one or more input ports and said waveguide transition includes a microstrip T-junction;

wherein said second port is positioned on a first side of said waveguide transition, and said third port is positioned on a second side of said waveguide transition.

20. The balun of claim 19 wherein said third waveguide is a microstrip waveguide, and wherein one end of said third microstrip waveguide represents said second port.

21. The balun of claim 20 wherein said slotline is positioned on a first side of said microstrip T-junction, and wherein an opposite end of said second waveguide represents said third port, said opposite end positioned on a second side of said microstrip T-junction.

22. The balun of claim 21 wherein said slotline is part of a slotline inverter in said groundplane.

* * * * *

UNITED STATES PATENT AND TRADEMARK OFFICE

CERTIFICATE OF CORRECTION

PATENT NO. : 6,891,446 B2
DATED : May 10, 2005
INVENTOR(S) : Tayrani et al.

It is certified that error appears in the above-identified patent and that said Letters Patent is hereby corrected as shown below:

Column 1,
Line 6, after "BACKGROUND OF THE INVENTION" please insert the following:
-- This invention was made with Government support under Contract Number F33615-98-2-1361 awarded by the Department of the Air Force. The Government has certain rights in this invention. --

Signed and Sealed this

Fifth Day of July, 2005

JON W. DUDAS
*Director of the United States Patent and Trademark Office*